United States Patent [19]

Chikanobu et al.

[11] 4,241,512

[45] Dec. 30, 1980

[54] DRAWING APPARATUS

[75] Inventors: Kimijima Chikanobu; Kosakai Asao; Shioya Tutomu; Tatsumi Tomotaka, all of Takasaki, Japan

[73] Assignee: Max Co. Ltd., Tokyo, Japan

[21] Appl. No.: 29,441

[22] Filed: Apr. 12, 1979

[30] Foreign Application Priority Data

Apr. 17, 1978 [JP] Japan ..... 53-49421[U]
Jan. 5, 1979 [JP] Japan ..... 54-818

[51] Int. Cl.[3] ..... B43L 13/02
[52] U.S. Cl. ..... 33/438
[58] Field of Search ..... 33/1 M, 430, 438, 439–447; 364/561, 562; 235/95 DN

[56] References Cited

U.S. PATENT DOCUMENTS 3,822,474 9/1974 Yada et al. ..... 33/438

FOREIGN PATENT DOCUMENTS 273099 4/1951 Switzerland ..... 33/438

*Primary Examiner*—Harry N. Haroian

[57] ABSTRACT

A drawing apparatus provided with calculative function of a calculation portion. A universal parallel ruler in which operating keys and a calculation result display portion for operating the calculative function are disposed on the surface of a member, the base of which is connected with an operating grip of a head portion to project sideways of the member, the head portion being disposed to be moved and set to any position on a drawing board by guide rail members or jointed arm members and supporting a vertical scale and a horizontal scale to be set to any angle.

3 Claims, 8 Drawing Figures

DRAWING APPARATUS

This invention relates to a universal parallel ruler which supports a head portion mounting a vertical scale and a horizontal scale such that said head portion can be moved and set to any position on a drawing board by means of a guide rail member like a longitudinal rail and a vertical rail or jointed arm members. Particularly said head portion in the universal parallel ruler according to the present invention is provided with operating keys which permit to operate a calculating mechanism for performing computation associated with drawing, or computation associated with operation of the head portion, and with display means which indicate the result of various computations.

And the present invention is to facilitate various necessary computations accompanying drawing, while permitting said computation without impeding the original functions of a universal parallel ruler.

In the head portion of this type of conventional universal parallel ruler, a scale mounting plate is connected to a rotatable shaft of grip portion supported rotatably by the head portion, and provided with a vertical scale and a horizontal scale in such manner that each scale projects at right angles to the other and can be set to any angular position by the rotating movement of said grip portion. The amount of rotating movement of said grip portion, i.e. the rotational angle of scale can be read on a graduated disc-like board with angular scale provided about said rotatable shaft and further read on a vernier scale board disposed on the outer periphery of the graduated board so that the scales can be set accurately to any desired angular position. Also, said grip portion provides a grasping portion for moving the scale to any position on the drawing board and further supporting fixedly the scale close to the drawing board, i.e. it provides an operating shaft for transporting horizontally and turning as well as supporting fixedly the scale. Further when the whole head portion is lifted up from the drawing board, that is, pivoted up vertically from the drawing board so as to permit drawing paper to be stretched on or removed from the drawing board, this grip portion is grasped for such operation.

Recently the development of drawing apparatus provided with calculative function has been attempted to carry out rapidly various calculations necessary for drawing and facilitate drawing operation when this type of universal parallel ruler is used for the drawing.

For example, a calculation mechanism has been proposed which is integrally built in the scale of a universal parallel ruler so that the scale itself also can be used as a calculator.

However such calculator integral with the scale has the disadvantage that when a new line is accurately drawn close to the previously drawn ones which are seen through the scale for confirmation the calculator provides an obstacle to viewing. Also it has other disadvantages in that the construction of the scale itself becomes complicated and the calculator has to be built in each interchangeable scale when the scale is interchanged for use according to drawing dimensions. Also since the setting angle of the scale is changed during drawing by rotating the grip portion, drawing can be hardly performed with ease when the calculator is built in the scale located remote from the rotatable supporting point.

An object of the present invention is to provide a universal parallel ruler with built-in calculator which overcomes these defects, and is conveniently operated and easily operated through the head portion without impeding any original functions of a universal parallel ruler.

Still another object of the present invention is to permit the accurate operation and confirmation of calculation results of a universal parallel ruler with ease by concentrating operating keys for operating the calculator built in said ruler and a display portion for indicating the result of the calculation near the grip portion which is an operating center portion of the head portion.

A further object of this invention is to permit the universal parallel ruler itself to be capable of various calculations with its own calculating function so that draftsmen do not need to prepare for any separate individual calculators in addition to the universal parallel ruler. Hereinafter a preferred embodiment of the present invention will be described with reference to the accompanying drawings; in which.

Figure 1:
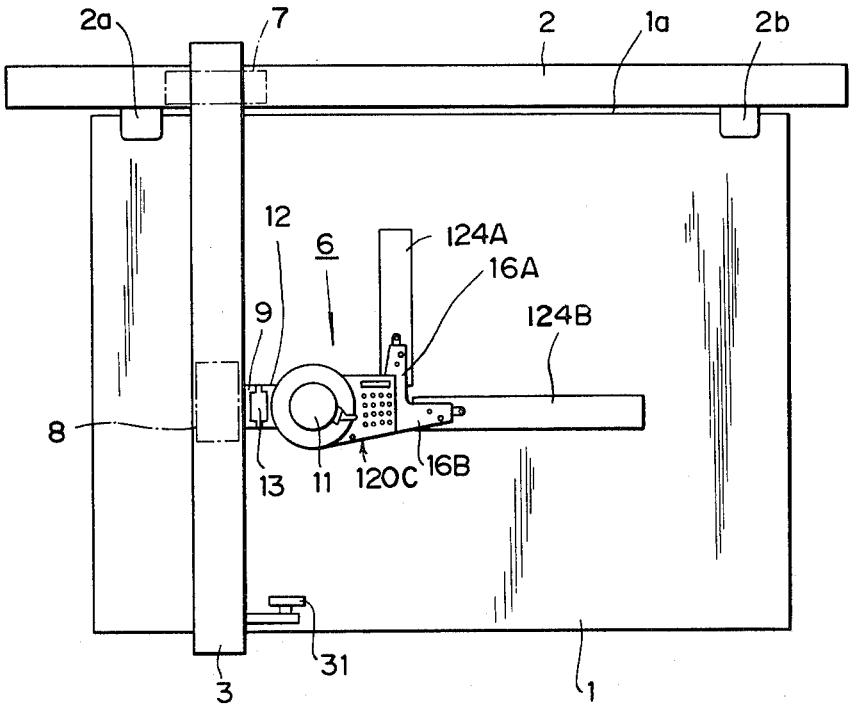
FIG. 1 is a pictorial plan view showing schematically the general arrangement of a universal parallel ruler according to this invention.
Figure 8:
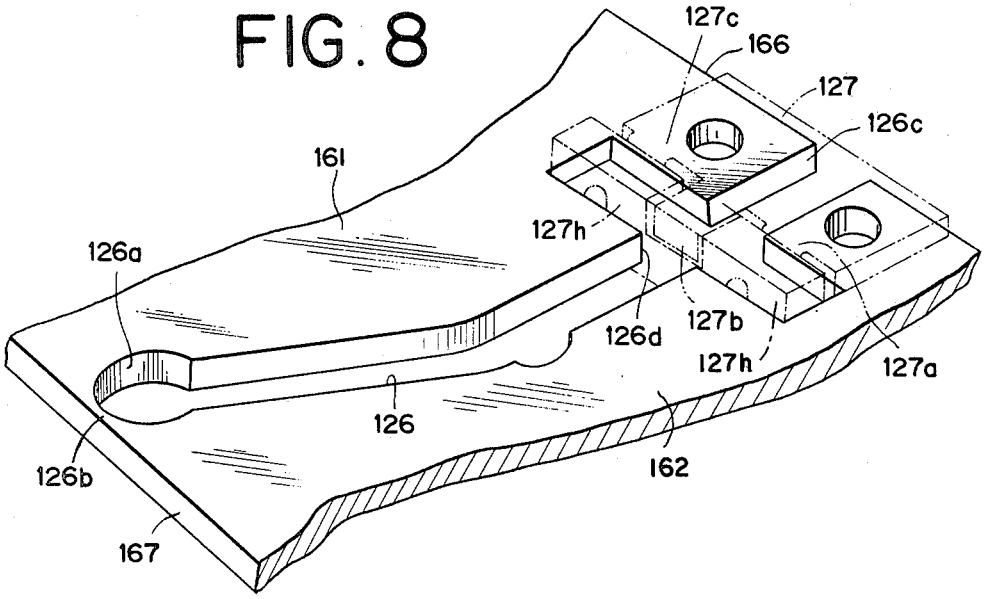

FIG. 8 is a partially cutaway perspective view of a fine adjustment portion of the ruler. Referring to FIG. 1, a drawing board 1 is supported on a supporting structure or the like (not shown). A horizontal rail 2 is fixed to the drawing board 1 by fixtures 2*a*, 2*b* respectively such that the rail 2 is located along the upper edge 1*a* of the drawing board 1. Also a vertical rail 3 is connected perpendicularly to said horizontal rail 2 such that the vertical rail 3 is capable of moving horizontally as viewed in the drawing. On the lower end of this vertical rail 3 in the same drawing is mounted a tail roller 31 which rolls on the drawing board 1 and supports movably the lower end of the vertical rail 3.

Also on said horizontal rail 2 is disposed horizontally movably a horizontal carriage 7 provided with rollers (not shown) which are guided along the surface of horizontal guide rail 2, and upper end of the vertical rail 3 is connected to said horizontal carriage 7. Also on said vertical rail 3 is disposed vertically movably a vertical carriage 8 provided with rollers (not shown) which are guided along the surface of the vertical guide rail 3, and a head portion 6 is connected to this vertical carriage 8 through a connecting member 9.

Hereinafter a detailed example of this head portion 6 will be described with reference to each of FIGS. 2 to 7.

The head portion 6 shown in these drawings is provided not only with all well-known functions of a drawing head, but also an electronic calculation mechanism which is integrally built into the head portion 6. This electronic calculation mechanism permits various calculations accompanying drawing operation and the indication of calculation results on the head portion. An example of a head portion is shown which permits the indicated result to be immediately read while the grip operation is carried out.

In these drawings numeral 11 designates the grip portion which is horizontally rotatably supported on one end of a supporting arm 12. Further the other end of said supporting arm 12 is pivotably supported on one end of a hinge plate 13 through hinge mechanisms 13*a*, 13*b* and the other end of said hinge plate 13 is mounted for pivotal movement about a pair of pivots 14'a, 14*b* opposed to each other for example to be connected to connecting member 9 of vertical carsol 8 which is slidably movable on vertical rail 3. (See FIG. 1).

Also said grip portion 11 is connected rigidly with the upper end of a shaft 15 and a scale mounting plate 16 is connected rigidly with the lower end of said shaft 15. In this embodiment, a first operating lever 17 and a second operating lever 18 project at the side of said grip portion 11. The modes of operation such as the fixation of the grip portion at any angle or fixation of the same at every predetermined angle, for example at 15° intervals or free rotation can be obtained by pressing in and pulling out these operating levers 17, 18 or rotating the same about the shaft 15. Further the concrete construction of this part will not be detailed since it may be constructed as same way as the conventional head portion and is not the main part of this invention. A numeral 19 designates a divided circle which is formed disk-like and provided circumferentially on the surface with a minute-degree graduation 110. A numeral 111 designates a vernier board which is disposed around the outer periphery of said divided circle 19 and provided with a vernier graduation 112. A numeral 113 designates a head case which has a generally plane annular shape and a portion bent to extend outwardly at an intermediate part of the circumference in which bent portion 114 said vernier board 111 is accommodated. A numeral 114*a* designates a third lever which operates a clutch mechanism (not shown) for interconnecting and disconnecting the divided circle 19 and the grip portion 11. Further said head case 113 supports a transparent dust protective cover 115 which covers the upper surface of the divided circle 19 and the vernier board 111. When for example in this cover 115 only one portion 115*a* corresponding to the vernier graduation 112 and the adjacent portions of the minute-degree graduation 110 is made transparent while the other portion 115*b* and the remaining portion above the minute-degree graduation 110 is made colored and transparent, the operator's sight can be concentrated on the transparent plate 115*a*. A numeral 116 designates a lower case of the head which is disposed at the lower surface side of said scale mounting plate 16 such that it covers the lower surface of said head case 113 and the lower surface of a calculator case which will be described later. A numeral 117 designates a calculator case which consists of an upper half 118 and a lower half 119 each made thin box-like. In this embodiment while various operating keys 120 for operating a calculating electronic circuit (not shown) built in the calculator case 117 are arranged on the upper surface of the upper half 118, a window 121 for indicating the result of calculation is formed also on the same surface such that liquid crystal display means and the like (not shown) for example can be viewed through the window 121. Also various electronic parts and the like (not shown) constituting the calculator are built in said calculator case 117. While this calculator case 117 is formed on one side edge with a shape conforming to the outer peripheral shape near the bent portion 114 of said head case 113 the calculator case 117 is formed on the other side with a shape capable of covering approximately the upper surface of said scale mounting plate 16 except for scale fitting portions 16A, 16B. A dial receiving recess 122 bent arcuately in said upper half 118 is disposed in the lower corner of said other side. A numeral 123 designates a fine adjustment dial for operating a fine adjustment portion of a scale which will be detailed later. And the outer periphery 123*a* of this dial 123 projects outwardly a little both on the other side and the lower side of said case 117.

Also a numeral 124A designates a vertical scale and a numeral 124B a horizontal one.

Figure 7:
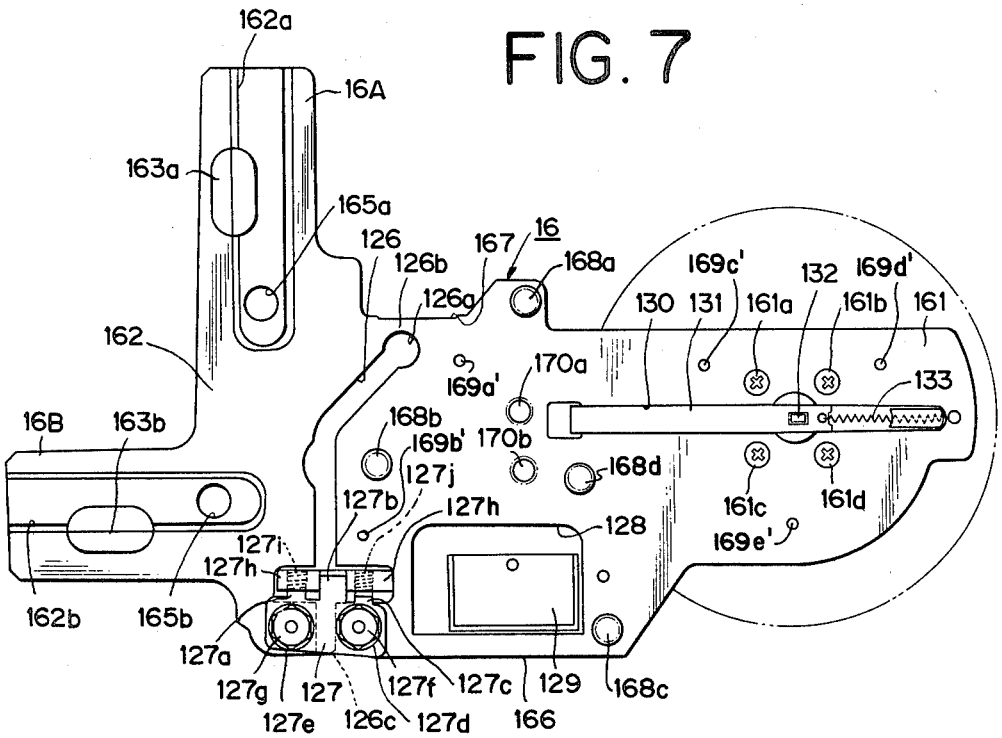
FIG. 7 is a bottom view of a scale mounting plate of the ruler.

Next said scale mounting plate 16 will be detailed in connection with FIGS. 7 and 8. This scale mounting plate 16 is formed by a somewhat thick plane metal plate which is punched or cut. One end 161 of this mounting plate 16 is rigidly connected by set-screws 161*a*, 161*b*, 161*c* and 161*d* with the lower end of vertical shaft 15, and is horizontally disposed. The other end 162 of said mounting plate 16 is formed with a vertical scale fitting portion 16A and a horizontal scale fitting portion 16B which project perpendicularly to each other. These scale fitting portions 16A and 16B are provided on the lower surfaces respectively with scale engaging dovetail grooves 162*a*, 162*b* which extend to the end of the fitting portions. Scales 124 can be mounted on the scale fitting portions by inserting into these grooves 162*a*, 162*b* connector fittings 126*a*', 126*b*' which have dovetail sections to engage these grooves and are fixed to the scales 124 near the upper side edges by each pair of set-screws 125*a*, 125*a*' and 125*b*, 125*b*'. Also scale fixing pawls 163*a*, 163*b* are disposed on one side of said respective grooves 162*a*, 162*b* and the scales 124 can be tightly fixed by tightening fastening screws 164*a*, 164*b* disposed on the upper surface side to the male screw shaft of said pawls 163*a*, 163*b*. Further openings 165*a*, 165*b* are provided respectively near the inner end of said grooves 162*a*, 162*b*, and the vertical or horizontal mounting state of the scale 124 can be adjusted by loosening the set-screws 125*a*', 125*b*' from the upper surface side of the scale mounting plate 16 with a tool (not shown) under the condition that the set-screws 125*a*', 125*b*' of one of scales 124 face these openings 165*a*, 165*b*. Also this scale mounting plate 16 in this embodiment has a notch slot 126 which opens at the lower side edge 166 and extends to near the upper side edge 167. This slot 126 serves for the fine adjustment of the mounting angle of said respective straight scales 124 to the scale mounting plate 16. The end of this slot 126 has a round hole portion 126*a*. Only a small connecting portion 126*b* is left between said portion 126*a* and said upper side edge 167. Also an adjusting plate 127 is disposed near the opening end 126*c* of said slot 126 such that it spans the slot 126. This adjusting plate 127 is formed on one longitudinal side with three cut-out lugs 127*a*, 127*b*, 127*c*, the central lug 127*b* of which is left projecting sideways, the respective lugs 127*a*, 127*c* at both sides being erected vertically toward the upper surface side. Also sector-shaped holes 127*d*, 127*e* are provided near both ends of adjusting plate 127. Into one of the holes 127*d* is inserted engageable a shaft 127*f* which is studded in the scale mounting plate 16 portion located at one side of said slot 126, and an eccentric shaft 127*g* extends through the other hole 127*e*. An orthogonal elongated slot 126*d* is formed continuously near the opening end 126*c* of said slot 126 and said respective lugs 127*a*, 127*c* erected from adjusting plate 127 face the interior of this slot 126*d*. Springs 127*i*, 127*j* extend through an elastic material piece 127*h* superposed on said central lug 127*b* and interposed between said respective lugs 127*a*, 127*c* and the side walls 126*d'*, 126*d''* of said slot 126*d* opposed thereto to elastically urge the adjusting plate 127 upwards as viewed in FIG. 7. Also said eccentric shaft 127*g* extends through a through hole (not shown) provided in the scale mounting plate 16 and protrudes from the upper surface side of this plate 16 to mount said fine adjustment dial 123 at the upper end. Thus, by rotating said dial 123 the eccentricity of rotating eccentric shaft 127*g* permits said slot 126 of scale mounting plate 16 to be forcibly expanded or contracted. Further the scale mounting plate 16 has a part 162 to one side of said slot 126, i.e. the side of scale mounting portions 16A, 16B side, that can be moved forcibly by a fine amount about the opening and closing fulcrum near said connection portion 126*b*. On the other hand, a part 161 to the other side of said slot 126 of scale mounting plate 16, i.e. the side portion connected to the shaft 15 of said grip portion 11 at one end, is left fixed. Also a numeral 128 designates an opening for removably attaching a battery. Thus this opening 128 is formed at a position corresponding to a battery receiving portion 129 formed in said calculator case 117. A numeral 130 designates an elongated slot in which a pawl rod 131 having an engaging pawl (not shown) at the end fits slidably. Said pawl rod 131 engages at the base end side portion the lower end 132 of swing rod (not detailed) operated swingably by said second lever 18 so that it is moved left and right as viewed in FIG. 7. by reciprocating the second lever 18 to make said engaging pawl engage and disengage from the engaging recess of a division engaging plate (not shown). This pawl rod 131 is urged elastically by tensile spring 133 rightward in FIG. 7, i.e. in the direction in which engaging said pawl engages said engaging recess. Also 168*a*, 168*b* and 168*c* are set-screws for mounting fixedly the calculator case 117 on the scale mounting plate 16. Further these set-screws 168*a* to 168*c* fix the calculator case 117 only on the right side of said slot 126 of the scale mounting plate 16 in FIG. 7, that is, on the side of end 161. Further 169*a* to 169*e* are threaded holes for fixing the lower case 116 of the head to the scale mounting plate 16. Each of these threaded holes 169*a* to 169*e* is formed only to the left of said slot 126 of scale mounting plate 16 in FIG. 6, i.e. on the portion of end side 161 so that the lower case 116 of the head is fixed to the scale mounting plate 16 on the portion which is near the one end rather than the slot 126. And to the portion which is near the other end 162 rather than said slot 126 of scale mounting plate 16. i.e. to the portion at the left side in FIG. 6 except for scale 124 no members are fixed, i.e. neither the calculator case 117, nor the lower case 116 of the head.

Also numerals 170*a*, 170*b* designate through holes for removably fitting screws 171*a*, 171*b* which fix said vernier board 111 to the head case 113.

Figure 2:
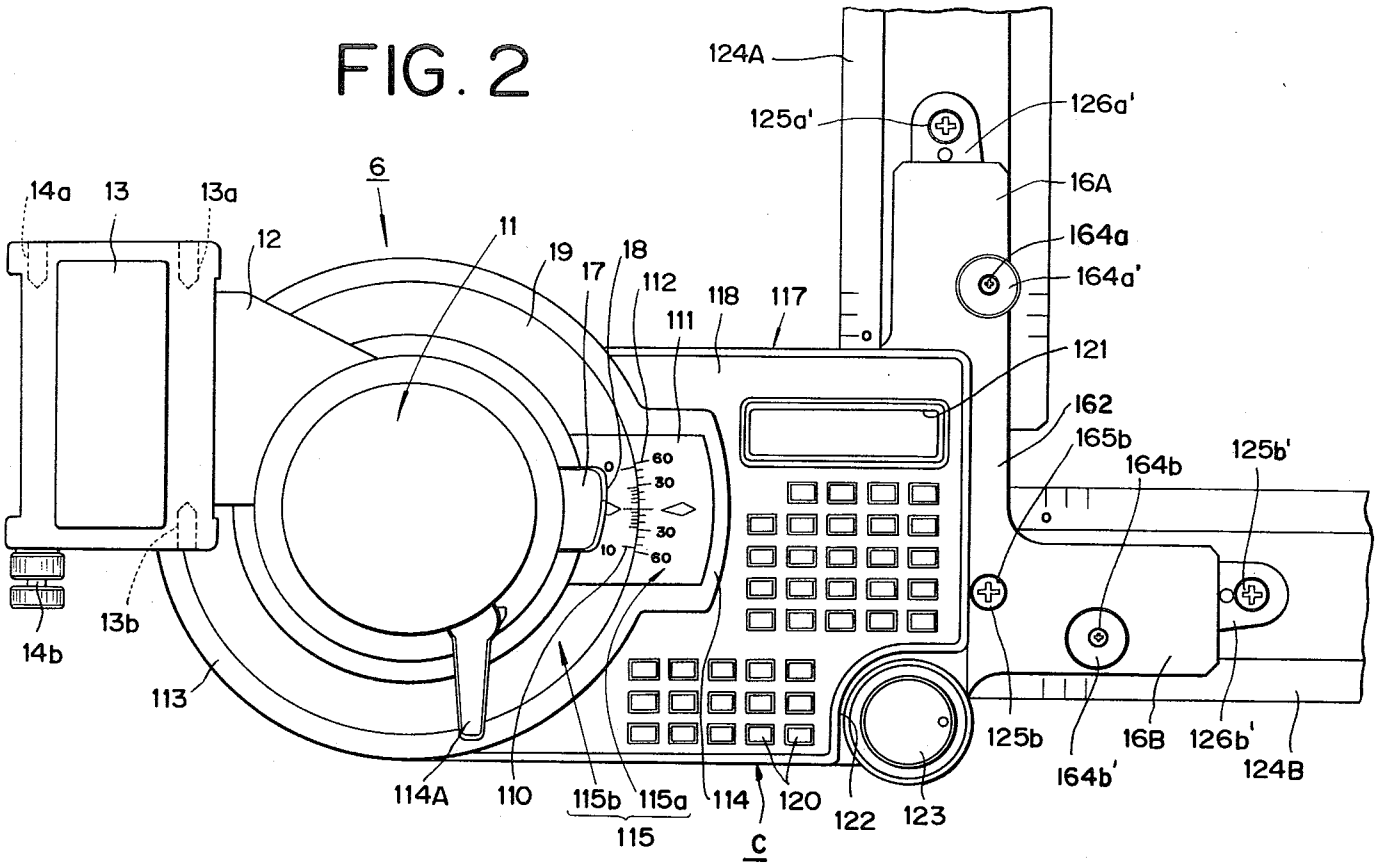
FIG. 2 is a plan view of the head portion of the ruler.
Figure 3:
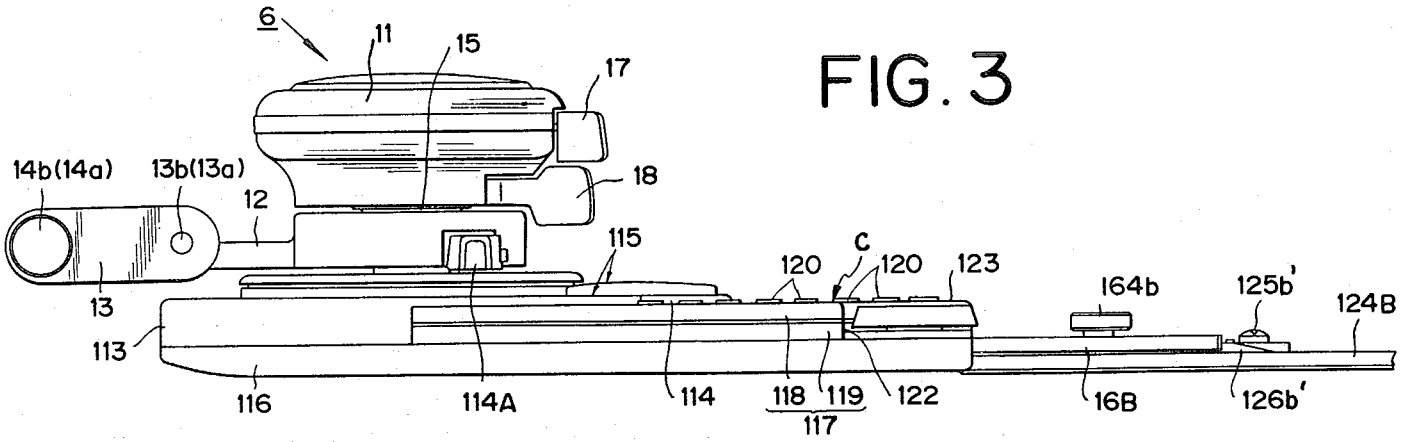
FIG. 3 is a front view of the head portion.
Figure 4:
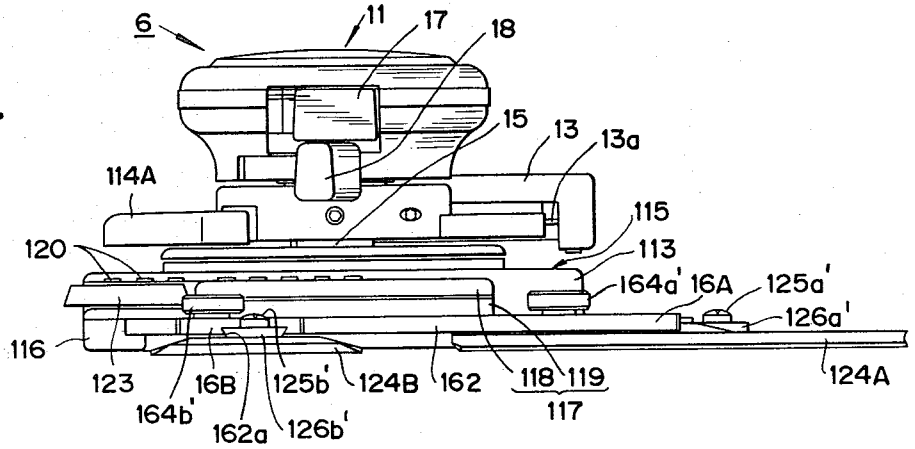
FIG. 4 is a right side view of the head portion.
Figure 5:
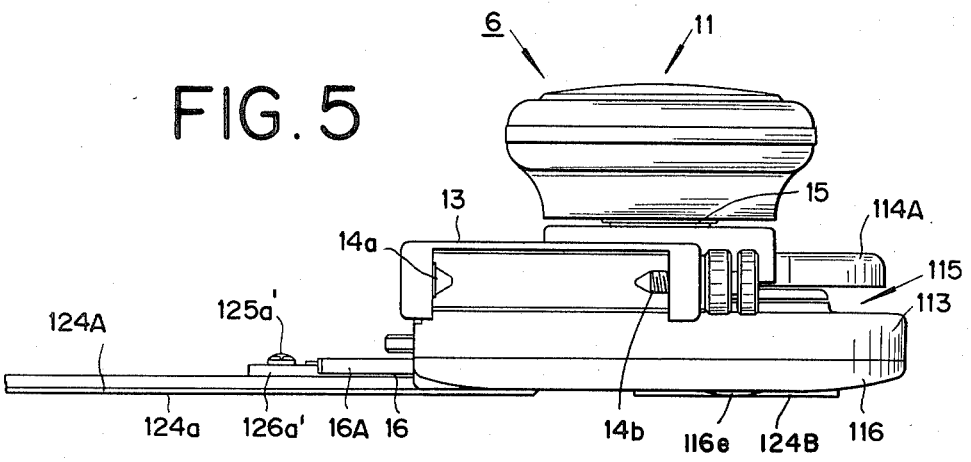
FIG. 5 is a left side view of the head portion.
Figure 6:
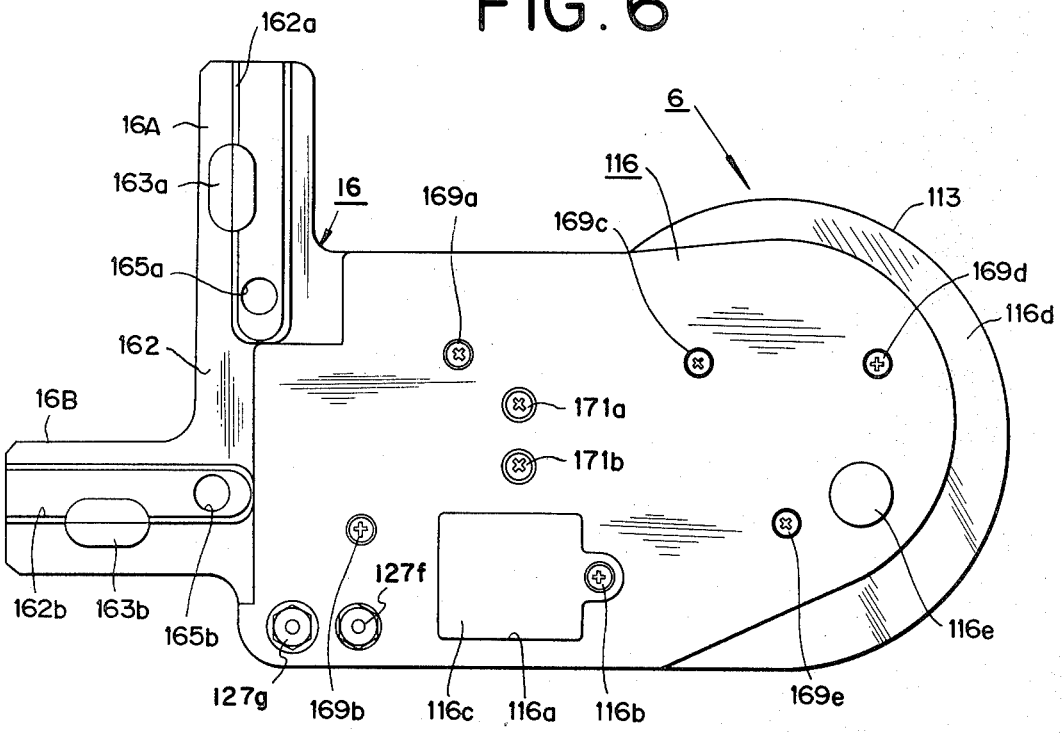
FIG. 6 is a bottom view of the head portion.

Next, said calculator case 117 will be detailed. In this case 117 are built a calculation circuit and the like which are constituted from circuit parts and the like connected to the base plate of a printed circuit (not shown). The whole case 117 is shaped such that it can cover the surface side portion of scale mounting plate 16 projecting sideways of head case 113 except for scale fitting portions 16A, 16B, i.e. at least said slot 126 portion. And the left side edge in FIG. 2 is shaped to conform to the right side edge of the head case 113 in FIG. 2. Namely in this embodiment a recess portion conforming to the bent portion 114, i.e. said vernier board holding portion, is formed near the central portion of a recess which has a curvature corresponding to that of the outer periphery of head case 113.

This calculation case 117 is fixed to said scale mounting plate 16 by set-screws 168*a* to 168*c*. Though in FIG. 2 the right end portion of said case 117 is not fixed directly to the scale mounting plate 16, it covers said slot 126 from above. Further in this embodiment the operating keys 120 and the display window 121, etc. arranged on the upper surface of calculator case 117 are disposed in a position lower than that of the surface of said division board 115 and vernier board 111 so that when the head portion is rotatably operated by the grip portion 11 the operating keys, etc. provide no obstacles against this rotating operation nor produce malfunction by contacting the other parts of a draftsman during said rotating operation.

Next, said lower case 116 of the head portion will be detailed. This case 116 is fixed such that it covers the whole lower side surface of the scale mounting plate 16 from the lower surface side of said scale mounting plate 16. This case 116 is fixed to the scale mounting plate 16 only on the portion which is near the one end rather than said slot 126 in the same manner as said calculator case 117.

This case 116 is provided in a position corresponding to said opening 128 with an opening 116*a* in which a battery lid 116*c* is disposed to be removably mounted by a screw 116*b* . Further while a number of various set-screws 169*a* to 169*e*, screw 116*b*, etc. are to be screwed into case 116 from the lower surface side of this case 116, all these screw receiving portions are recess-shaped so that the heads of the screws do not protrude from the lower surface of the case 116 to keep the lower surface of the case 116 plain. Also the lower surface of said case 116 is formed near the right periphery in FIG. 6 with a semicircular inclined wall surface 116*d* which provides an escape portion when the head portion is operatively inclined to lift the straight scales 124 about the fulcrum of a projection 116*e* formed projectingly near the lower end approximately corresponding to the postion in which the grip portion 11 is disposed. Also the lower surface of said case 116 is not flush with the lower surface 124*a* of each scale 124 mounted on the scale fitting portions 16A, 16B of scale mounting plate 16 and the lower surface 124*a* of scale 124 protrudes slightly lower.

Then in said embodiment when the head portion is completely assembled the minute-degree graduated board 19 is located around the grip portion 11 and further at the right side of the outer periphery of the minute-degree graduated board 19 in FIG. 2 is located the vernier board 111. Further in FIG. 2 the calculator case 117 is disposed at the right side of the vernier board 111 continuously. The vertical and horizontal straight scales 124A, 124B are connected to the right side of the case 117 in FIG. 2 to project perpendicularly to each other and the fine adjustment dial 123 is disposed at the lower right corner of said calculator case 117 in FIG. 2. Accordingly a draftsman grasps the grip portion 11 with his left hand, holds or rotates it and set said scale 124 at any position to the desired angle on the drawing board by operating each of the first and second levers 17, 18 with the thumb of the left hand grasping said grip portion 11. He can perform a drawing operation or operate said operating keys 120 for carrying out necessary calculations for the drawing with his right hand which is not needed for the setting operation of scale 124. Further in the same way he can perform fine adjustment of the projecting angle of each scale 124 to the scale mounting plate 16 by rotating the fine adjustment dial with his right hand. In this case since said dial 123 is disposed in the corner of the calculation case, he can perform accurately the fine adjustment while observing the scale 124.

Also, when the head portion 6 is depressed against the drawing board with the grip portion 11 being grasped, the lower surface of each straight scale 124 projects somewhat lower than the lower surface of head portion 6, that is, the lower side surface of lower case 116 of the head so that the lower surface 124*a* of scale 124 together with said projection 116*e* of the head portion first makes contact with the drawing board. When the lower surface 124*a* is depressed in such condition by the grip portion 11, the intermediate portion of scale mounting plate 16 deflects downwardly, a little, i.e. toward the drawing board side to set tightly the scale 124 to the drawing board. Sinc particularly the said scale mounting plate 16 can be elongated, said deflection state is easily obtained.

Also on the intermediate portion of said scale mounting plate 16 are constituted the fine adjustment portion of scale mounting angle from said slot 126, adjusting plate 127, etc., and the fine adjustment mechanism provided with a hinged mechanism can be easily realized only by cutting and forming said slot 126 in the scale mounting plate 16. The portion adjusted finely by the fine adjustment portion is only the one on the left side of said slot 126 in FIG. 7 and independent of either said calculator case 117 or lower case 116 of the head portion without any trouble in the fine adjustment. Also the operational force for this fine adjustment is applied to the vicinity of the opening end 126*c* of said slot 126 through said adjusting dial 123 so that the fine adjustment can be performed centering about the fine adjustment fulcrum of connecting portion 126*b*. Further said fine adjustment portion in this head portion 6 is not exposed to the exterior since it is interposed between and covered by both the calculation case 117 and the lower case 116 of the head from above and below. Also since the scale mounting plate 16 is provided in the position corresponding to the battery receiving portion with the notched opening 128, the wall thickness of scale mounting plate 16 in this opening 128 can be utilized for the battery receiving portion to permit the thickness of calculation case 117 to be reduced by the thickness of the plate 16.

Also since the scale mounting plate 16 is provided with a plurality of notch hole portions such as said slot 126 and said opening 128, it has an advantage in that the whole weight can be sufficiently reduced compared with the conventional one while it is made large-scale.

Furthermore since the calculation case 117 has said construction, independent prefabricated calculators can be fixedly built into the scale mounting plate 16 so that it can be assembled on the original production line centering about the electronic circuit arrangement while the division mechanism centering about the mechanical arrangement is produced on another line. Further since this case 117 is formed with the bent side wall which has the shape conforming to the bent portion 114 for receiving the vernier board of head case 113, the aligning operation of each part in said assembly can be easily and accurately performed.

Further due to the construction of this grip portion 11 of head portion 6, associated division mechanism (not shown), said minute-degree graduated board 19, vernier board 111 and head case 113, the conventional head portion without the calculator case 117 can be advantageously formed and utilized as it is when only the scale mounting plate 16 and the lower case 116 of head are interchanged.

What is claimed is:

1. A drawing head of a drawing machine having a rotatable spindle for extending perpendicularly to a drawing board, a protractor and a protractor housing for receiving rotatably said protractor being disposed around said rotatable spindle, a bed plate, the lower end of said rotatable spindle being fixed to said bed plate, said bed plate comprising a fixed portion having an unchangeable azimuth angle with reference to said rotatable spindle, and a movable portion which is divided from said fixed portion by a slot and having a variable width for changing its azimuth angle with reference to said rotatable spindle, said movable portion being formed with a scale mounting portion to which straight scales are removably fixed, said drawing head comprising a casing for an electronic calculator, said casing being located between the protractor housing and the scale mounting portion on the surface of said bed plate of the drawing head and fixed to the fixed portion to cover the whole slot, said fixed portion, and a part of the movable portion and to permit the azimuth angle of the movable portion with reference to the rotatable spindle to be changed, and a bottom plate which covers a part of said movable portion, protractor, protractor housing, said fixed portion and said slot and which is fixed to said fixed portion on the lower surface side of said bed plate of the drawing head.

2. A drawing head of a drawing machine as defined in claim 1, comprising: a battery receiving portion for receiving a battery of said calculator, the battery receiving portion being exposed in an opening formed in the fixed portion of the bed plate of the drawing head to permit changing of the battery.

3. A drawing head of a drawing machine as defined in claim 2, wherein an opening closed by a removable cover is provided in a position of said bottom plate corresponding to the opening of the bed plate of the drawing head, to permit the battery to be changed through said opening from the lower surface side of the drawing head.

* * * * *